US006509816B1

(12) United States Patent
Staker et al.

(10) Patent No.: US 6,509,816 B1
(45) Date of Patent: Jan. 21, 2003

(54) ELECTRO CERAMIC MEMS STRUCTURE WITH OVERSIZED ELECTRODES

(75) Inventors: Bryan P. Staker, Pleasanton, CA (US); Douglas L. Teeter, Jr., Mountain View, CA (US); Thomas A. DeBey, San Jose, CA (US); David T. Amm, Kingston (CA)

(73) Assignee: Glimmerglass Networks, Inc., Hayward, CA (US)

( * ) Notice: Subject to any disclaimer, the term of this patent is extended or adjusted under 35 U.S.C. 154(b) by 0 days.

(21) Appl. No.: 09/918,897

(22) Filed: Jul. 30, 2001

(51) Int. Cl.[7] ..... H01H 51/22
(52) U.S. Cl. ..... 335/78; 200/181
(58) Field of Search ..... 335/78–86; 257/414, 257/421, 527, 531; 200/180–181

(56) References Cited

U.S. PATENT DOCUMENTS 5,619,061 A * 4/1997 Goldsmith et al. ..... 257/528
5,627,396 A * 5/1997 James et al. ..... 257/415
5,668,033 A * 9/1997 Ohara et al. ..... 438/113
6,100,477 A * 8/2000 Randall et al. ..... 200/181
6,384,353 B1 * 5/2002 Huang et al. ..... 200/181

* cited by examiner

*Primary Examiner*—Lincoln Donovan
*Assistant Examiner*—Tuyen T. Nguyen
(74) *Attorney, Agent, or Firm*—Townsend and Townsend and Crew LLP; Kenneth R. Allen

(57) ABSTRACT

An array apparatus has a micromachined SOI structure, such as a MEMS array, mounted directly on a class of substrate, such as low temperature co-fired ceramic, in which is embedded electrostatic actuation electrodes disposed in substantial alignment with the individual MEMS elements, where the electrostatic electrodes are configured for substantial fanout and the electrodes are oversized such that in combination with the ceramic assembly are configured to allow for placement of the vias within a tolerance of position relative to electrodes such that contact is not lost therebetween at the time of manufacturing.

4 Claims, 1 Drawing Sheet

ELECTRO CERAMIC MEMS STRUCTURE WITH OVERSIZED ELECTRODES

BACKGROUND OF THE INVENTION

This invention relates to electro ceramic components such MEMS arrays and methods for fabricating electro ceramic components with high density interconnects and that maintain relative internal alignment. Components constructed according to the invention are MEMS arrays or other micromachined elements.

Conventional MEMS array structures comprise Silicon on Insulator (SOI) array structures in which is fabricated an integrated electrode array. One of the problems encountered is placement accuracy control from within the substrate element to the bottom surface of the electrostatic actuation electrodes due to fabrication tolerance limitations. In particular, when the substrate is a low-temperature co-fired ceramic (LTCC), shrinkage variance of the ceramic may be greater than is allowable for a particular design. What is needed is a solution that allows for achievable via alignment accuracy to the underlying actuation electrodes in such manner as to not compromise the device design of the corresponding MEMS actuatable element.

SUMMARY OF THE INVENTION

According to the invention, an array apparatus has a micromachined SOI structure, such as a MEMS array, mounted directly on a class of substrate, such as low temperature co-fired ceramic, in which is embedded electrostatic actuation electrodes disposed in substantial alignment with the individual MEMS elements, where the electrostatic electrodes are configured for substantial fanout and the electrodes are oversized such that in combination with the ceramic assembly are configured to allow for placement of the vias within a tolerance of position relative to electrodes such that contact is not lost therebetween at the time of manufacturing.

In a specific embodiment, the electrodes are sized to accommodate the entire space available between MEMS devices even though the required design of the electrodes for the MEMS device may be smaller. This allows for greater tolerance or variance in the placement of vias from the substrate to the actuation electrodes. This structural design allows for an increased density and increased overall array size that is manufacturable. A single or multiple deposition of dielectric material is deposited over the electrodes in the peripheral areas away from the SOI cavities so that the conductive SOI handle is insulated from the electrodes.

The invention will be better understood by reference to the following detailed description in connection with the accompanying illustrations.

DESCRIPTION OF SPECIFIC EMBODIMENTS

Figure 1:
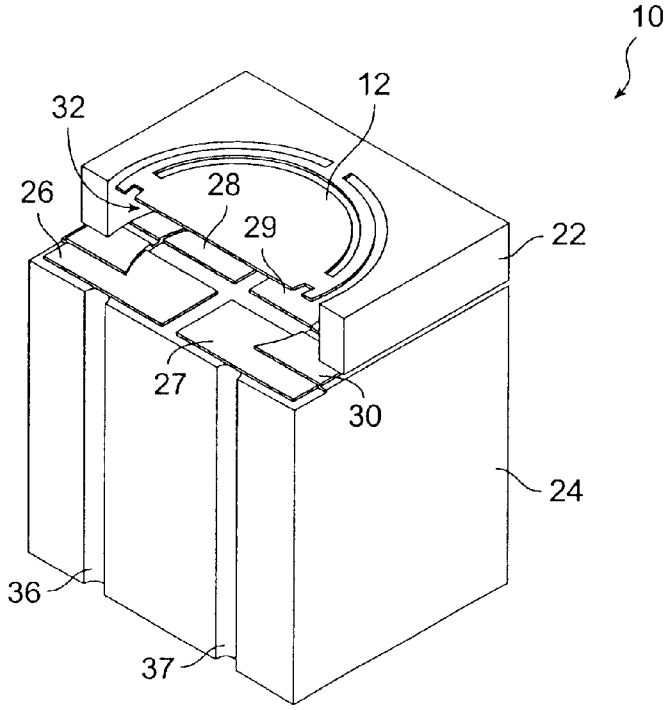
FIG. 1 is a perspective view in cutaway according to the invention.

Reference is made to FIG. 1 in which is shown an element 10 of a MEMS array (not shown) according to the invention, with a MEMS-based mirror 12 fabricated in an integrated Silicon on Insulator structure 22 and mounted on a substrate 24 which is configured for fanout. According to the invention electrodes 26, 27, 28, 29 are placed on the substrate 24 with vias 36, 37 etc. to a control module (not shown). A dielectric layer 30 is disposed between the structure 22 and the substrate 24 insulating the electrodes at the periphery of the MEMS cavity 32 from the structure 22.

Figure 2:
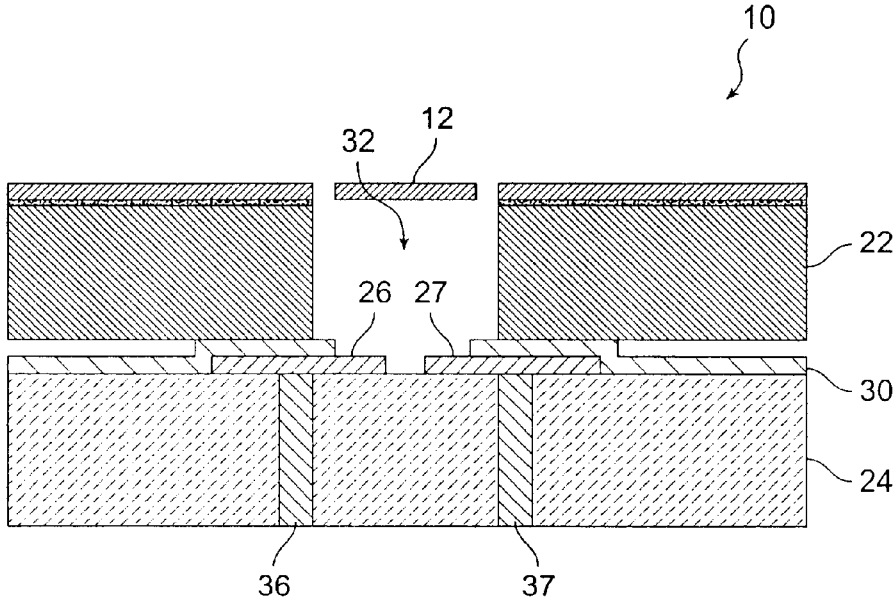
FIG. 2 is a side cross-sectional view of a single array element according to the invention.

Referring to FIG. 2, two electrodes 26, 27 are shown in cross-section. According to the invention, the electrodes 26, 27 are larger than is required to fit within the cavity 32 and are insulated by dielectric 30 from the structure 22 where they extend beyond the boundaries of the cavity 32. The vias 36, 37 may be electrically connected with the electrodes 26, 27 at any point under the surfaces of the electrodes 26, 27 and need not be precisely within the region of the cavity 22. The dielectric 30 may terminate at the periphery of the cavity 32, or it may cover the whole electrode surface.

The invention has been explained with reference to specific embodiments. Other embodiments will be evident to those of ordinary skill in the art. Therefore, it is not intended that this invention be limited, except as indicated by the appended claims.

What is claimed is:

1. In a MEMS array apparatus, a MEMS element comprising:

a substrate of a co-fired ceramic which is subject to variance in temperature-dependent shrinkage;

a MEMS support structure defining a cavity and having an actuatable element, said MEMS support structure attached to said substrate, said MEMS support structure being formed separately from said substrate of a composition distinguishable from material of said substrate;

a plurality of electrodes disposed on said substrate in alignment with said actuatable element and extending beyond boundaries of said cavity; and vias in said substrate of a size smaller in cross section than said electrodes, said vias being coupled to said electrodes within a tolerance of placement such that said vias align with said electrodes upon juxtaposition of said substrate to said MEMS support structure.

2. The apparatus according to claim 1 wherein a dielectric is disposed between said MEMS support structure and said electrodes for insulation.

3. The apparatus according to claim 1 wherein said dielectric insulator overlays said electrodes at least between said MEMS support structure and a confronting surface of said electrodes.

4. The apparatus according to claim 2 wherein said dielectric insulator terminates adjacent the periphery of the cavity.

* * * * *